US006381884B1

(12) United States Patent
Bouleau et al.

(10) Patent No.: US 6,381,884 B1
(45) Date of Patent: May 7, 2002

(54) STEAM IRON SOLE PLATE

(75) Inventors: Jean-Paul Bouleau, Champfleur (FR); Marc Sadler, Venice (IT)

(73) Assignee: Moulinex, S.A., Cormelles le Royal (FR)

( * ) Notice: Subject to any disclaimer, the term of this patent is extended or adjusted under 35 U.S.C. 154(b) by 0 days.

(21) Appl. No.: 09/831,737

(22) PCT Filed: Nov. 12, 1999

(86) PCT No.: PCT/FR99/02791

§ 371 Date: Aug. 13, 2001

§ 102(e) Date: Aug. 13, 2001

(87) PCT Pub. No.: WO00/29661

PCT Pub. Date: May 25, 2000

(30) Foreign Application Priority Data

Nov. 13, 1998 (FR) ..... 98 14604

(51) Int. Cl.[7] ..... D06F 75/38

(52) U.S. Cl. ..... 38/93

(58) Field of Search ..... 38/93

(56) References Cited

U.S. PATENT DOCUMENTS

| | | | | | |
|---|---|---|---|---|---|
| 2,846,793 | A | * | 8/1958 | Studer | 38/93 |
| 4,658,520 | A | * | 4/1987 | Henneberger et al. | 38/93 |
| 5,146,700 | A | * | 9/1992 | Prosser | 38/93 |
| 5,907,916 | A | * | 6/1999 | Hahnewald et al. | 38/93 |
| 6,122,849 | A | * | 9/2000 | Kida et al. | 38/93 |

* cited by examiner

*Primary Examiner*—Ismael Izaguirre
(74) *Attorney, Agent, or Firm*—Young & Thompson

(57) ABSTRACT

Steam iron sole plate comprising a heating metallic base (12) comprising a vaporization chamber, and a metallic plate (14) mounted on the base, whose external surface (15) forms a pressing surface and which is pierced by holes (22) communicating with the vaporization chamber.

Figure 1:
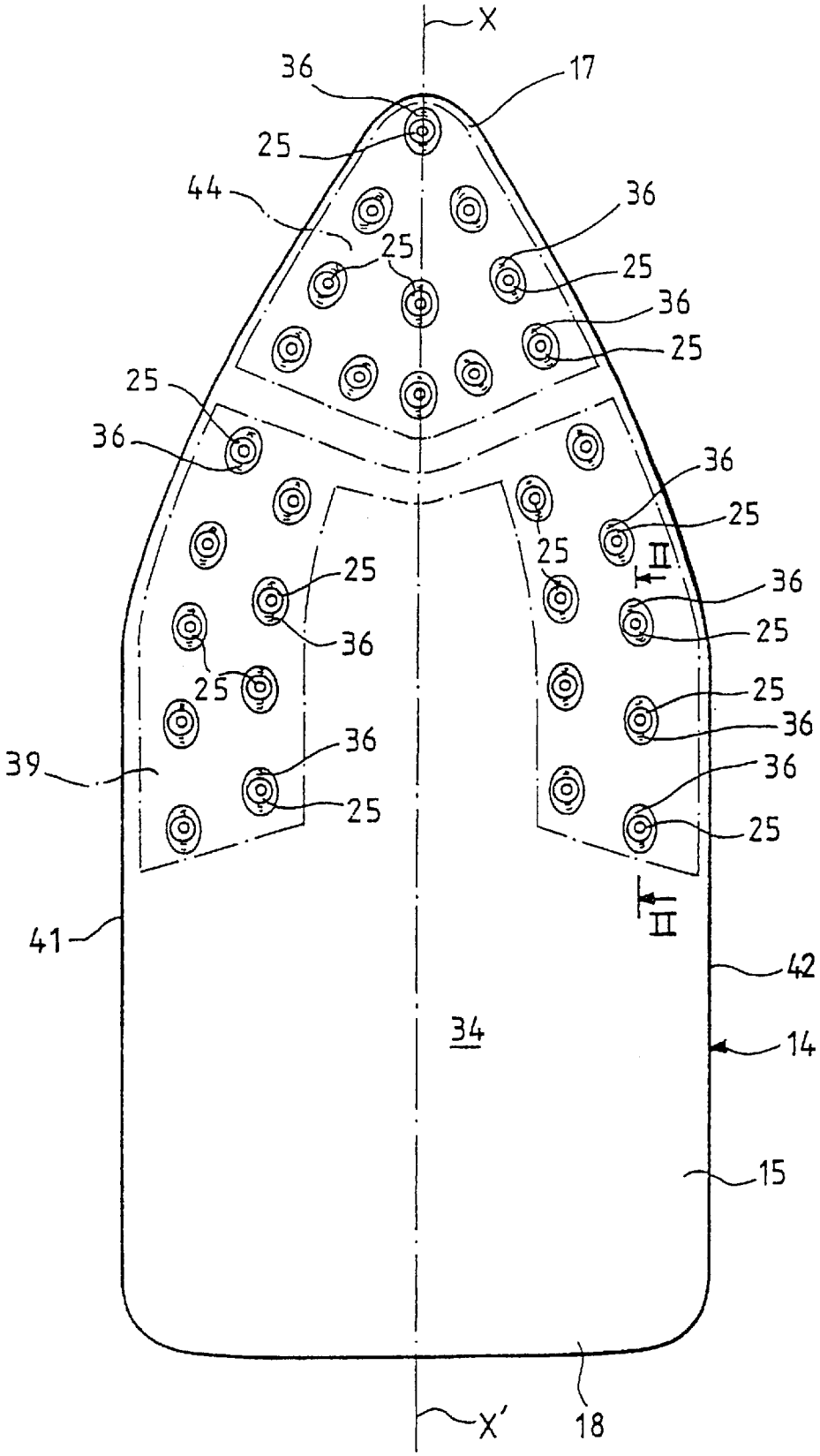

According to the invention, a tubular lug of resilient material (25) is disposed about each hole (22) of the plate (14) and borders the internal surface of the hole (22) so as to form a steam outlet passage (26).

10 Claims, 2 Drawing Sheets

STEAM IRON SOLE PLATE

The present invention relates generally to electric steam irons, and concerns more particularly a steam iron sole plate comprising a metallic heating base comprising at least one vaporization chamber, and a metallic plate mounted on the heating base, whose external surface is adapted to form a pressing surface and which is pierced with holes communicating with the vaporization chamber.

In a known steam iron sole plate of this type, the steam emitted from the vaporization chamber leaves at a predetermined flow rate through holes provided in the metal plate constituting itself a pressing plate, via a steam distribution chamber provided in the heating base and communicating with the vaporization chamber and the outlet holes for steam of the pressing plate.

However, as is well known, it happens that after several heating cycles, small plates of scale deposit tenaciously and solidly on the internal surface of the steam outlet holes of the metal pressing plate, and ultimately plug these holes, preventing thereafter any emission of steam onto the articles to be pressed. To descale the holes of the metallic pressing plate, the user must use a tool, just as for example a reamer, with the help of which he strongly scrapes the internal surface of each hole, which is particularly troublesome and little effective for descaling, and can result from user's clumsiness in scoring the ironing plate.

The invention has particularly for its object to overcome these drawbacks and to provide a steam iron sole plate of the type described above, which can be easily cleaned to remove scale from the holes of the metallic pressing plate.

According to the invention, a tubular lug of resilient material is disposed in each hole of the plate and surrounds the internal surface of said hole so as to form an outlet passage for the steam.

Thus, the holes of the metal pressing plate are thereafter internally protected by the lugs of resilient material through which leaves the steam emitted in the vaporization chamber provided in the heating base of the sole plate. Moreover, the scale that may be deposited on the resilient material of the lugs is present in a brittle form, such that by simple friction exerted on these lugs, the deposited scale detaches very easily thanks to the resilient deformation of the lugs.

According to another characteristic of the invention, the lugs are interconnected over all or in several portions, by a common connection member which is arranged between the lower surface of the heating base and the internal surface of the metallic plate.

Preferably, the lugs and the connection member are molded of a single piece of a resilient material, such as an elastomer of the silicone type resistant to high temperature. This embodiment by molding the lugs and their connection member is desirably simple, less costly and well suited for mass production.

Figure 2:
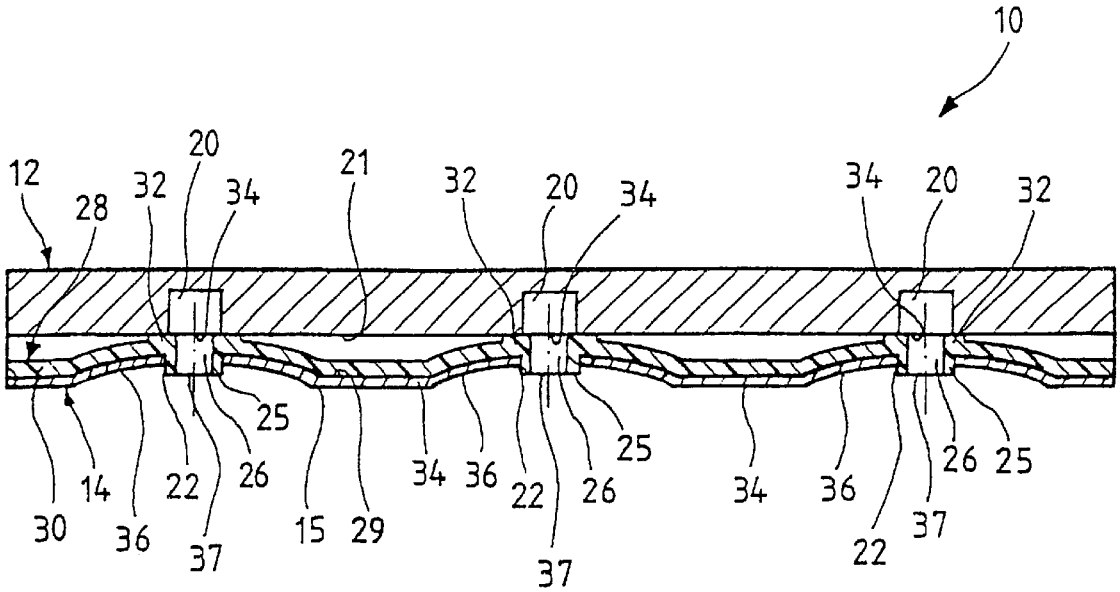

The characteristics and advantages of the invention will become further apparent from the description which follows, by way of non-limiting example, with reference to the accompanying drawings, in which:

FIG. 1 is a plan view of the external surface of a pressing plate of a steam iron sole plate according to the invention; and FIG. 2 is a cross-sectional view, on an enlarged scale, on the line II—II of FIG. 1.

In the embodiment shown in FIGS. 1 and 2, the sole plate 10 (FIG. 2) of an electric steam iron comprises a base 12 of cast metal, for example of aluminum, in which is embedded an electric heating resistance (not shown) and to which is connected, by any suitable securement means, a thin pressing plate 14 made of a metallic material, such as for example chrome plated steel or stainless steel, whose external surface 15 is adapted to form a pressing surface.

As shown in FIG. 1, the sole plate extends longitudinally from a region forming a point 17 to a region forming a heel 18, and has a longitudinal axis of symmetry shown at XX'.

In a manner known per se, in the heating base 12 of the sole plate, FIG. 2, is provided at least one vaporization chamber (not shown) communicating with the steam distribution openings 20 which open through the lower surface 21 of the heating base 12 and which communicate with holes 22 pierced in the pressing plate 14.

According to the invention, in each hole 22 of the pressing plate 14 is disposed a tubular lug 25 which is made of a resilient material such as, preferably, an elastomer of the silicone type resistant to high temperature, and which surrounds the internal surface of the hole 22 so as to form a steam outlet passage 26, as shown in FIG. 2.

By way of purely illustrative example, the holes 22 and the tubular lugs 25 are round.

Preferably, with respect to FIG. 2, the lugs 22 are interconnected, either completely, or in several portions, by a common connection member 28 which is arranged, pointwise between the lugs which it connects, between the lower surface 21 of the heating base 12 and the internal surface 29 of the pressing plate 14.

In the embodiment shown in FIG. 2, the connection member 28 is in the form of a layer 30 which is common to all the lugs 25 and which extends over the arrangement of holes provided in the pressing plate 14. Preferably, the layer 30 and the lugs 25 are molded of a single piece in the resilient material, in this case in an elastomer of the silicone type resistant to heat.

In this example, the layer 30 molded with the lugs 25 is pressed against the internal surface 29 of the pressing plate 14 by means of small collars 32 forming flanges made by molding, which surround the upper opening of the lugs 25 and on each of which is pressed the lower surface 21 of the heating base 12. As shown in FIG. 2, each steam distribution opening 20 communicates directly with one of the lugs 25, such that each small collar 32 forms a joint between the steam distribution opening 20 and the corresponding steam outlet lug 25.

As to FIGS. 1 and 2, the pressing plate 14 has, both externally and internally, a flat surface, designated 34 in these figures, which is provided, at the level of each hole 22 (FIG. 2), with a slightly concave depression 36 which is directed toward the heating base 12 and at the top of which is located the hole 22; as shown in FIG. 2, the lower opening 37 of each lug 25 projects beyond the hole 22 of the corresponding depression 36 while remaining slightly on this side of the flat surface 34 of the pressing plate 14.

Thus, it will be understood that after several heating cycles, the scale is deposited in vapor form on the silicone of the lugs 25 and, by introducing a rigid tool into each lug, easily detaches thanks to the resilient deformation of the lugs, thereby permitting the user to carry out easy and effective descaling.

In the embodiment shown in FIG. 1, the resilient lugs 25 are distributed over two separate zones or regions for steaming, one, designated 39, corresponding to a distribution of the lugs 25 adjacent the two lateral edges 41, 42 of the plate 14 and adapted for the emission of continuous jets at low pressure, and the other zone, designated 44, corresponding to a grouping of the lugs 25 at the point 17 of the plate 14 and adapted for the emission of steam jets of high pressure and strong penetration. Of course, the sole plate of the iron can have more than two steaming regions, without thereby departing from the scope of the invention.

In this example, the resilient lugs 25 of the two steaming zones 39 and 44 are both of the same color, thereby giving the sole plate of the iron an aesthetic character. By way of modification, the resilient lugs 25 of one of the two steaming regions, for example those of the steaming agent 39, are of the same color, but of a color different, and preferably contrasting from that of the resilient lugs 25 of the other steaming region, in this case the lugs of the steaming region 44, thereby giving the sole plate of the iron a particularly attractive appearance.

What is claimed is:

1. Steam iron sole plate comprising a metallic heating base (12) comprising at least one vaporization chamber, and a metallic plate (14) mounted on the heating base (12), whose external surface (15) is adapted to form a pressing surface and which is pierced with holes (22) communicating with the vaporization chamber, characterized in that a tubular lug of resilient material (25) is disposed about each hole (22) of the plate (14) and borders the internal surface of said hole (22) so as to form a steam outlet passage (26).

2. Iron sole plate according to claim 1, characterized in that each lug (25) is made of an elastomer of the silicone type resistant to high temperature.

3. Iron sole plate according to claim 1 or 2, characterized in that the lugs (25) are interconnected, in whole or in several parts, by a common connection member (28) which is arranged between the lower surface (21) of the heating base (12) and the internal surface (29) of the metallic plate (14).

4. Iron sole plate according to claim 3, characterized in that the lugs (25) and the connection member (28) are molded of a single piece of a resilient material, such as an elastomer of the silicone type resistant to high temperature.

5. Iron sole plate according to claim 3 or 4, characterized in that the connection member (28) is in the form of a layer (30) common to all the lugs (25).

6. Iron sole plate according to any one of the preceding claims, characterized in that the metallic plate (14) has a flat surface (34) provided, at the level of each hole (22), with a slightly concave depression (36) which is directed toward the heating base (12) and at the top of which is located a hole (22), and the lower outlet (37) of each lug (25) projects beyond the hole (22) of the corresponding depression (36) while remaining slightly on this side of the flat surface (34) of the plate (14).

7. Iron sole plate according to claims 4 or 6, characterized in that the connection member (28) molded with the lugs (25) is pressed against the internal surface (29) of the metallic plate (14) by means of small collars forming flanges (32) made by molding, which surround the upper outlet (34) of the lugs (25) and against each one of which is applied the lower surface (21) of the heating base (12), each small collar (32) thereby forming a joint.

8. Iron sole plate according to any one of the preceding claims, in which the heating base (12) comprises steam distribution openings (20) opening through the lower surface (21) of said base (12), characterized in that each of the steam distribution openings (20) communicates directly with one of the lugs (25).

9. Iron sole plate according to any one of the preceding claims, in which the holes (22) of the plate (14) are distributed in at least two separate so-called steam regions (39, 44), characterized in that the lugs (25) disposed about the holes (22) belonging to the two steam regions (39, 44) are all of the same color.

10. Iron sole plate according to any one of claims 1 to 8, in which the holes (22) of the plate (14) are distributed in at least two separate so-called steam regions (39, 44), characterized in that the lugs (25) disposed about the holes (22) belonging to one (39) of the two steam regions are of the same color, but of a different color from that of the lugs (25) disposed about the holes (22) belonging to the other steam region (44).

* * * * *